United States Patent [19]

Iio et al.

[11] Patent Number: 4,941,810

[45] Date of Patent: Jul. 17, 1990

[54] SLIDING-VANE ROTARY COMPRESSOR

[75] Inventors: Masahiro Iio; Yoshio Suzuki; Hidehiko Takayama; Katsumi Sakamoto, all of Konan, Japan

[73] Assignee: Diesel Kiki Co., Ltd., Tokyo, Japan

[21] Appl. No.: 366,136

[22] Filed: Jun. 14, 1989

[30] Foreign Application Priority Data

Jul. 15, 1988 [JP] Japan ..... 63-93590[U]

[51] Int. Cl.[5] ..... F04C 18/344; F04C 29/08

[52] U.S. Cl. ..... 418/15; 418/270

[58] Field of Search ..... 418/15, 259, 270

[56] References Cited

U.S. PATENT DOCUMENTS

| | | | |
|---|---|---|---|
| 4,389,170 | 6/1983 | Hayashi | 418/15 |
| 4,408,968 | 10/1983 | Inagaki et al. | 418/15 |
| 4,619,595 | 10/1986 | Amano et al. | 418/259 X |
| 4,668,172 | 5/1987 | Shibuya et al. | 418/270 |
| 4,702,684 | 10/1987 | Takao et al. | 418/259 |

FOREIGN PATENT DOCUMENTS

| | | | |
|---|---|---|---|
| 54986 | 5/1981 | Japan | 418/15 |

*Primary Examiner*—Michael Koczo
*Assistant Examiner*—Douglas J. Makosy
*Attorney, Agent, or Firm*—Wenderoth, Lind & Ponack

[57] ABSTRACT

A sliding-vane rotary compressor includes a cylinder having a plurality of discharge holes aligned in an axial direction of the cylinder, and a corresponding number of discharge valves normally closing the respective discharge holes. Respective openings of the discharge valves are limited in such a manner as to increase progressively in a direction from a front side to a rear side of the cylinder to thereby produce a pressure difference between the front and rear sides of the cylinder. With this pressure difference, the cylinder is normally urged toward one side and hence is unlikely to oscillate in the axial direction. The compressor thus constructed is capable of operating silently without generating an unpleasant oscillating noise.

2 Claims, 2 Drawing Sheets

SLIDING-VANE ROTARY COMPRESSOR

BACKGROUND OF THE INVENTION

1. Field of the Invention

The present invention relates to a sliding-vane rotary compressor for compressing a refrigeration medium, for example.

2. Description of the Prior Art

Sliding-vane rotary compressors, as disclosed for example in Japanese Utility Model Laid-Open Publication No. 61-92778, include a compressor body composed of a cylinder block having an inside guide surface, and front and rear side blocks disposed on opposite ends of the cylinder block, and a rotor rotatably disposed in the compressor body and carrying thereon a plurality of radially movable sliding vanes held in contact with the guide surface of the cylinder block. The vanes, rotor, cylinder block and front and rear side blocks jointly define therebetween a plurality of compression chambers in which a refrigeration medium is compressed.

The rotor is concentrically and fixedly mounted on a drive shaft. The drive shaft is rotatably supported on the front and rear side blocks via a pair of bearings, with a clearance between the respective side block and the rotor for smooth rotation of the rotor.

A front side end of the drive shaft is operatively connected with an electromagnetic clutch which includes a clutch plate coupled with the front side end of the drive shaft and a rotor being driven by a driving force from a suitable drive means such as an engine. When the electromagnetic clutch is energized, the clutch plate is attracted to the rotor, thereby transmitting the drive force to the drive shaft. With the rotation of the rotor, the vanes slide along the guide surface of the cylinder block to cause the compression chambers to be subsequently increased and decreased in volume with each revolution of the rotor, whereby the refrigeration medium drawn into the compression chambers is compressed and discharged from the compression chambers through discharge holes by forcibly opening respective valves associated with the discharge holes.

A problem associated with the conventional sliding-vane rotary compressor of the foregoing construction is that an unpleasant noise is produced while the compressor is operating. More particularly, in a sliding-vane rotary compressor having a total of five sliding vanes, the torque fluctuates ten times per one revolution of the rotor and the load fluctuates five times per one revolution of the rotor. Such fluctuation of torque and load produces a higher harmonic reasonance of the rotor which in turn brings about resonant vibration of other components leading to generation of an unpleasant noise.

The unpleasant noise is produced due to the presence of a clearance provided between the front side block and the rotor and also between the rotor and the rear side block for smooth rotation of the rotor. With the clearance thus provided, the rotor is allowed to oscillate in the axial direction when subjected to forces produced periodically when the torque and load of the rotor fluctuate.

SUMMARY OF THE INVENTION

With the foregoing difficulties in view, an object of the present invention is to provide a sliding-vane rotary compressor incorporating structural features which control or limit oscillation of a rotor occurring when the torque and load of the rotor fluctuate, thereby enabling a silent operation of the compressor.

According to the present invention, there is provided a sliding-vane rotary compressor comprising: a compressor body composed of a cylinder and a pair of side blocks attached to opposite ends of said cylinder, said compressor body having an inlet disposed at one of a front side and a rear side of said cylinder; a rotor rotatably disposed in said compressor body and carrying thereon a plurality of radially movable sliding vanes, there being defined between said cylinder, rotor and vanes a plurality of compression chambers which vary in volume with each revolution of said rotor; a plurality of aligned discharge holes disposed in a direction parallel to a longitudinal axis of said cylinder; a plurality of discharge valves disposed on said cylinder and normally closing said discharge openings, respectively, said discharge valves being displacable to open the corresponding discharge openings when they are forced to open by a compressed fluid, thereby allowing a compressed fluid to flow out from said compression chambers; and means for limiting the displacement of said discharge valves such that openings of the respective discharge valves progressively increase in a direction from the front side to the rear side of said cylinder when said inlet is disposed at said front side of said cylinder, and said openings of the respective discharge valves progressively increase in a direction from the rear side to the front side of said cylinder when said inlet is disposed at said rear side of said cylinder.

With this construction, since the valve opening at one side of the cylinder is greater than the valve opening at the other side of the cylinder, the pressure distribution in the compression chambers becomes greater at the one side than at the other side. With this pressure distribution, the pressure in a clearance at the one side between one of the front and rear side blocks and a confronting end face of the cylinder rises to thereby force the cylinder to move toward the other of the front and rear side blocks. The thus fluidally biased rotor is prevented from oscillating in the axial direction with the result the operation noise of the compressor can be considerably reduced.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION

The present invention will be described hereinbelow in greater detail with reference to an embodiment shown in the accompanying drawings.

Figure 1:
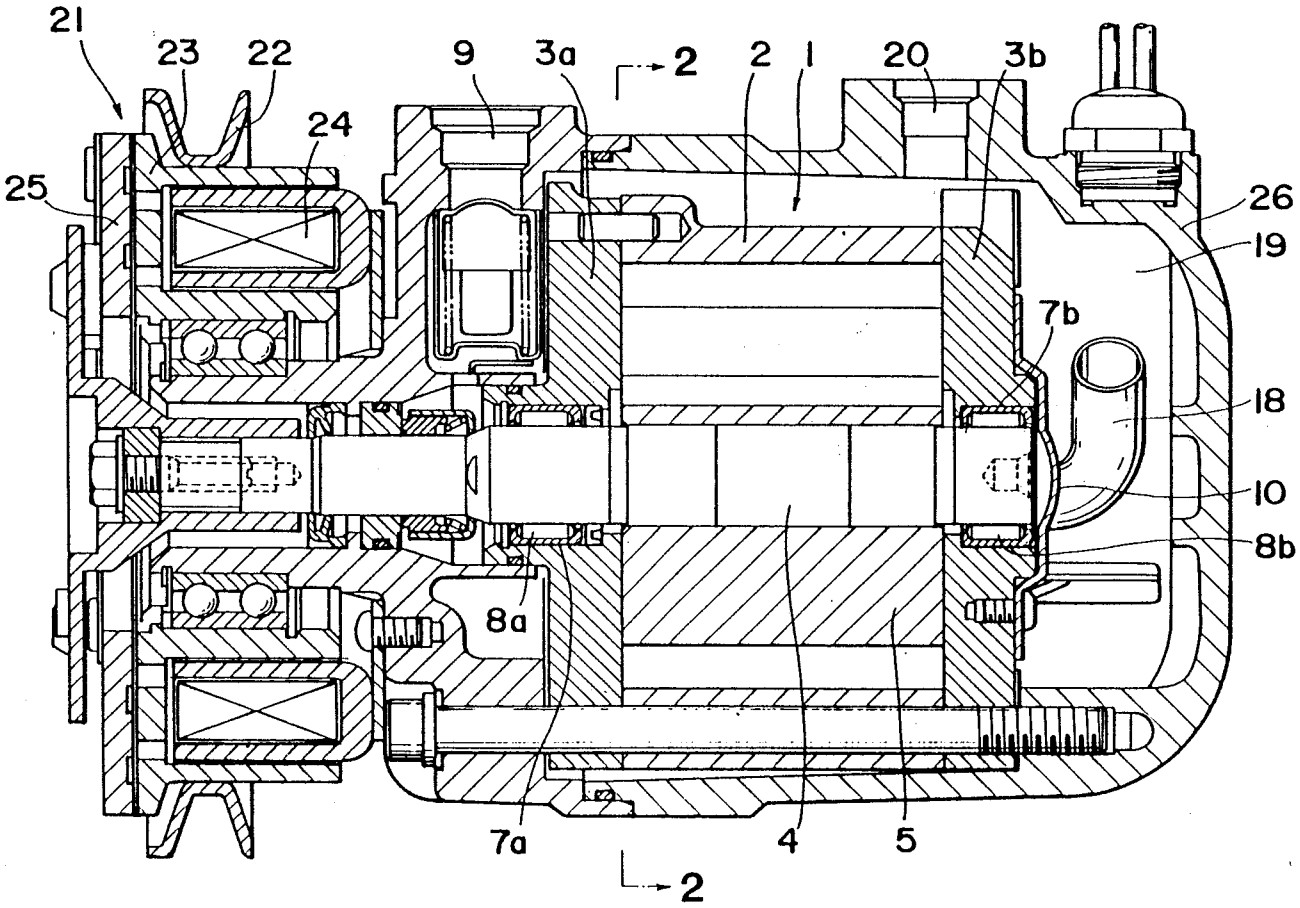
FIG. 1 is a longitudinal cross-sectional view of a sliding-vane rotary compressor according to the present invention.
Figure 2:
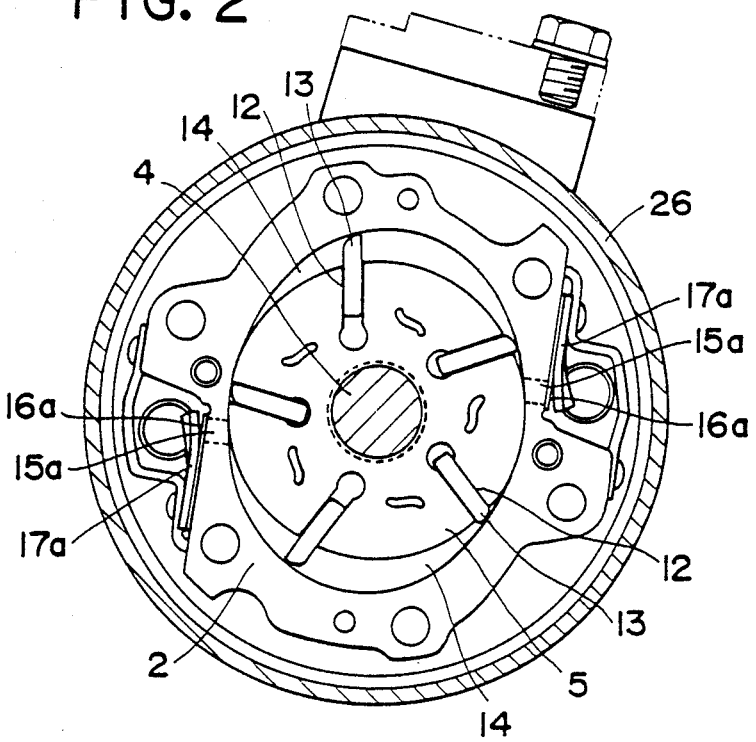
FIG. 2 is a cross-sectional view taken along line 2—2 of FIG. 1.
Figure 3:
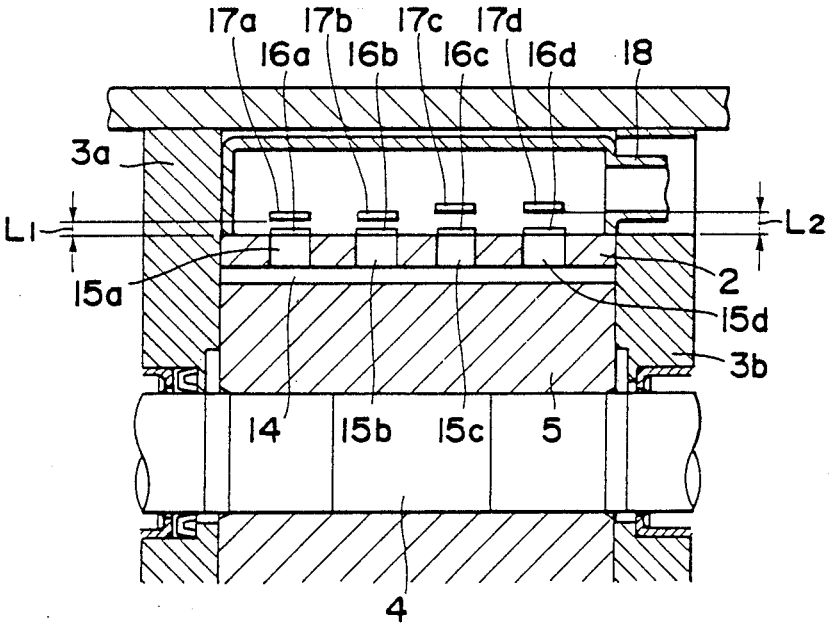
FIG. 3 is an enlarged longitudinal cross-sectional view of a main part of the rotary compressor.

As shown in FIGS. 1 through 3, a sliding-vane rotary compressor embodying the present invention includes a body 1 composed of a cylinder 2 having an inside guide surface of a desired configuration, and front and rear side blocks 3a and 3b secured to opposite ends of the cylinder 2. The compressor further includes a cylindrical rotor 5 concentrically and fixedly mounted on a drive shaft 4 and rotatably received in the compressor body 1 with diametrically opposite portions of the rotor 5 held in contact with the inside guide surface of the cylinder 2. The drive shaft 4 is rotatably supported on a pair of bearings 8a, 8b fitted respectively in a pair of axial holes 7a, 7b formed respectively in the front side block 3a and the rear side block 3b. The drive shaft 4 is connected at its one end to an electromagnetic clutch 21 for connection with a driving source. The other end of the drive shaft 4 is received within the hole 7b in the rear side block 3b. The hole 7b is blocked from fluid communication with a high pressure chamber 19 by means of a cover 10 secured to the rear side block 3b.

The electromagnetic clutch 21 includes a circular ring-shaped rotor 23 having an integral pulley 22, an electromagnet 24 mounted on the rotor 23 for magnetizing the same, and a clutch plate 25 disposed in confrontation to the rotor 23 and coupled with an end of the drive shaft 4. The rotor 23 is rotated by the driving source such as an engine via an endless belt, not shown, extending around the pulley 22 and a non-illustrated pulley on the driving means. In operation, an exciting current is supplied to the electromagnet 24 for engaging the clutch 21, the rotor 23 being rotated is magnetized by the electromagnet 24, thereby causing the clutch plate 25 to be attracted to the rotor 23. The clutch plate 25 is rotated in unison with the rotor 23 to thereby transmit the drive force to the drive shaft 4.

The rotor 5 has a plurality of substantially radially extending grooves 12 (FIG. 2) in which a corresponding number of sliding vanes 13 are movably received. While the compressor is operating, the vanes 13 are forced outwardly in to contact with the inside guide surface of the cylinder 2 by a back pressure produced behind the respective vanes and also by a centrifugal force produced by high-speed rotation of the rotor 5. The thus outwardly urged vanes 13 slide along the inside guide surface of the cylinder 2. Each time when each vane 13 passes through an intake hole (not shown) connected with an inlet 9 (FIG. 1), a refrigeration medium flows into a compression chamber 14 defined between the vane 13 and a succeeding vane and is trapped in the compression chamber 14. A plurality of such compression chambers 14 are defined between the adjacent vanes 13, rotor 5, cylinder 2, and front and rear side blocks 3a and 3b. The compression chambers 14 vary in volume progressively from a minimum value to a maximum value during the intake stroke. Conversely, during the discharge stroke, the volume of the compression chambers 14 progressively varies from the maximum to the minimum to thereby compress the refrigeration medium. When each vane 13 moves past a plurality of aligned discharge openings 15a through 15d defined in the cylinder 2 parallel to a longitudinal axis of the cylinder 2, the compressed refrigeration medium is discharged from the corresponding one of the compression chamber 14 through the discharge openings 15a–15d. In this instance, a plurality of discharge valves 16a–16d associated with the respective discharge openings 15a–15d are forced to open by the compressed refrigeration medium. The intake and discharge strokes are repeated to compress and discharge the refrigeration medium. The compressed refrigeration medium discharged from the discharge valves 16a–16d is guided by a discharge pipe 18 to flow into a high pressure chamber 19 defined in a shell 26 from which the compressed refrigeration medium is delivered to a device outside the compressor through an outlet 20.

The discharge valves 16a–16d correspond in number to the number of the discharge holes 15a–15d (four in the illustrated embodiment) and comprise reed valves normally closing the respective discharge openings 15a–15d, the reed valves 16a–16d being displacable to open the corresponding discharge openings 15a–15d when they are forced outwardly by the compressed refrigeration medium. Respective displacements of the reed valves 16a–16d are limited by valve stoppers or retainers 17a–17b (FIGS. 2 and 3) secured to the cylinder 2 adjacent to the corresponding reed valves 16a–16d and engageable with the reed valves 16a–16d. Two valve stoppers 17a and 17b disposed at a front side adjacent to the front side block 3a are spaced from the corresponding reed valves 16a and 16b to such an extent that the reed valves 16a, 16b are outwardly displacable by a distance L1 not exceeding 0.3 mm, for instance. The remaining valve stoppers 17c and 17d disposed at a rear side adjacent to the rear side block 3b are spaced from the corresponding reed valves 16c and 16d to such an extent that the reed valves 16c, 16d are outwardly displacable by a distance L2 greater than 0.5 mm, for instance.

Since the opening of each individual discharge hole 15a–15d is determined by the displacement of a corresponding one of the discharge reed valves 16a–16d (i.e., the opening of the reed valve), the limitation of the displacement of the respective valves 16a–16d varies the flow rate of the compressed refrigeration medium from the discharge holes 15a–16d. In the illustrated embodiment, the flow rate of the compressed refrigeration medium from the compression chamber 14 is greater at the rear side than at the front side so that a pressure difference is produced between the front side and the rear side of the compression chamber 14.

With this pressure difference, a relatively high pressure acts between the front side block 3a and a confronting end face of the rotor 5 to urge the rotor 5 toward the rear side block 3b. The thus fluidally biased rotor 5 is prevented from oscillating in the axial direction.

According to experiments, the magnitude of an axial oscillation of the rotor 5 was reduced by about 30% as compared with the axial oscillation of the rotor of a conventional compressor. The overall noise level was considably reduced and and a notable noise reduction was observed in a frequency range about 1 KHz. The compressor operated silently without generating an unpleasant oscillating noise.

The discharge valves 16a–16d are not limited to the reed valves of the illustrated embodiment but may be replaced with valves of a different type.

In the illustrated embodiment, the inlet 9 is disposed at the front side of the cylinder 2 so that the openings of the respective discharge valves progressively increase in a direction from the front side to the rear side of the cylinder 2, thereby forcing the cylinder toward the rear side block 3b. Though not shown, the inlet 9 may be provided at the rear side of the cylinder 2 in which instance the openings of the respective discharge valves progressively increase in a direction from the rear side to the front side of the cylinder 2, thereby forcing the cylinder 2 toward the front side block 3a.

Obviously, various modifications and variations of the present invention are possible in the light of the above teaching. It is therefore to be understood that within the scope of the appended claims the invention may be practiced otherwise than as specifically described.

What is claimed is:

1. A sliding-vane rotary compressor comprising:

(a) a compressor body composed of a cylinder and a pair of side blocks attached to opposite ends of said cylinder, said compressor body having an inlet disposed at one of a front side and a rear side of said cylinder;

(b) a rotor rotatably disposed in said compressor body and carrying thereon a plurality of radially movable sliding vanes, there being defined between said cylinder, rotor and vanes a plurality of compression chambers which vary in volume with each revolution of said rotor;

(c) a plurality of aligned discharge holes disposed in a direction parallel to a longitudinal axis of said cylinder;

(d) a plurality of discharge valves disposed on said cylinder and normally closing said discharge openings, respectively, said discharge valves being displacable to open the corresponding discharge openings when they are forced to open by a compressed fluid, thereby allowing a compressed fluid to flow out from said compression chambers; and (e) means for limiting the displacement of said discharge valves such that openings of the respective discharge valves progressively increase in a direction from the front side to the rear side of said cylinder when said inlet is disposed at said front side of said cylinder, and said openings of the respective discharge valves progressively increase in a direction from the rear side to the front side of said cylinder when said inlet is disposed at said rear side of said cylinder.

2. A sliding-vane rotary compressor according to claim 1, said limiting means comprising a plurality of valve stoppers secured to said cylinder adjacent to the respective discharge valves and each engageable with a corresponding one of said discharge valves for limiting the opening of the discharge valve when the compressed fluid is discharged.

* * * * *